United States Patent [19]

Sanford

[11] Patent Number: 4,561,370

[45] Date of Patent: Dec. 31, 1985

[54] RECREATIONAL WATERCRAFT

[76] Inventor: William D. Sanford, R.R. #1, Story City, Iowa 50248

[21] Appl. No.: 624,236

[22] Filed: Jun. 25, 1984

[51] Int. Cl.[4] ..... B63B 1/04; B63B 39/06; B63H 25/06

[52] U.S. Cl. ..... 114/56; 114/125; 114/126; 114/153; 114/163

[58] Field of Search ..... 114/56, 125, 126, 153, 114/163, 330, 332; 441/65, 72, 73, 79, 360

[56] References Cited

U.S. PATENT DOCUMENTS

| | | | |
|---|---|---|---|
| 1,125,772 | 1/1915 | Ullin | 114/332 |
| 1,187,179 | 6/1916 | Robeson | 114/21 R |
| 1,780,767 | 11/1930 | Scott-Paine | 114/163 |
| 2,646,765 | 7/1953 | Boles | 114/163 |
| 2,724,132 | 11/1955 | Shoup et al. | 114/360 |
| 2,881,730 | 4/1959 | Hall | 114/153 |
| 2,929,346 | 3/1960 | Perce | 114/330 X |
| 3,038,431 | 6/1962 | Bajulaz | 114/16 |
| 3,598,074 | 8/1971 | Schubert | 114/56 |
| 3,600,001 | 8/1971 | Fisher | 280/24 |
| 4,022,145 | 5/1977 | Tindal | 114/153 |
| 4,302,858 | 12/1981 | Casciano | 114/253 |

FOREIGN PATENT DOCUMENTS

| | | | |
|---|---|---|---|
| 682956 | 6/1930 | France | 114/163 |
| 1274168 | 12/1961 | France | 114/332 |
| 87509 | 8/1966 | France | 114/332 |
| 16351 | of 1902 | United Kingdom | 114/332 |

*Primary Examiner*—Sherman D. Basinger
*Attorney, Agent, or Firm*—Henderson & Sturm

[57] ABSTRACT

A recreational watercraft having a housing and a structure disposed within the housing for supporting a person. The housing is adapted to be moved through the water by being towed or in other ways. Foot operated rudders are provided on the forward part of the housing and on the rearward part of the housing and are linked together whereby movement of the forward rudder in one direction causes movement of the rear rudder in an equal and opposite direction for causing rapid movement from side to side of the watercraft. Additionally, hand operated rudders are provided for causing turning of the housing about a longitudinal axes.

13 Claims, 11 Drawing Figures

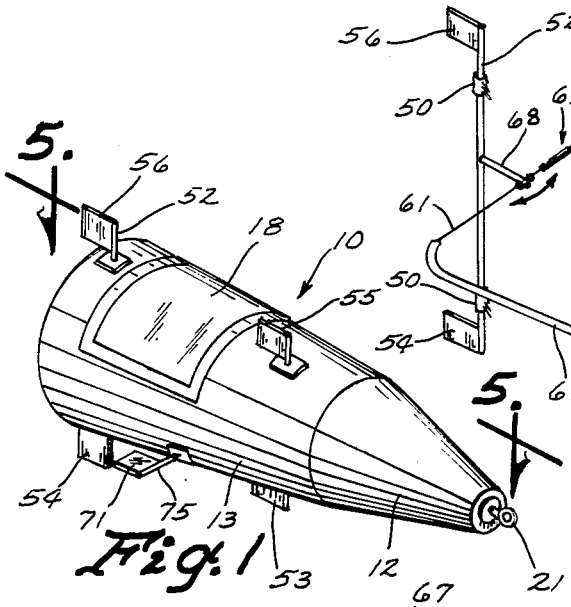
Fig. 1
Fig. 2
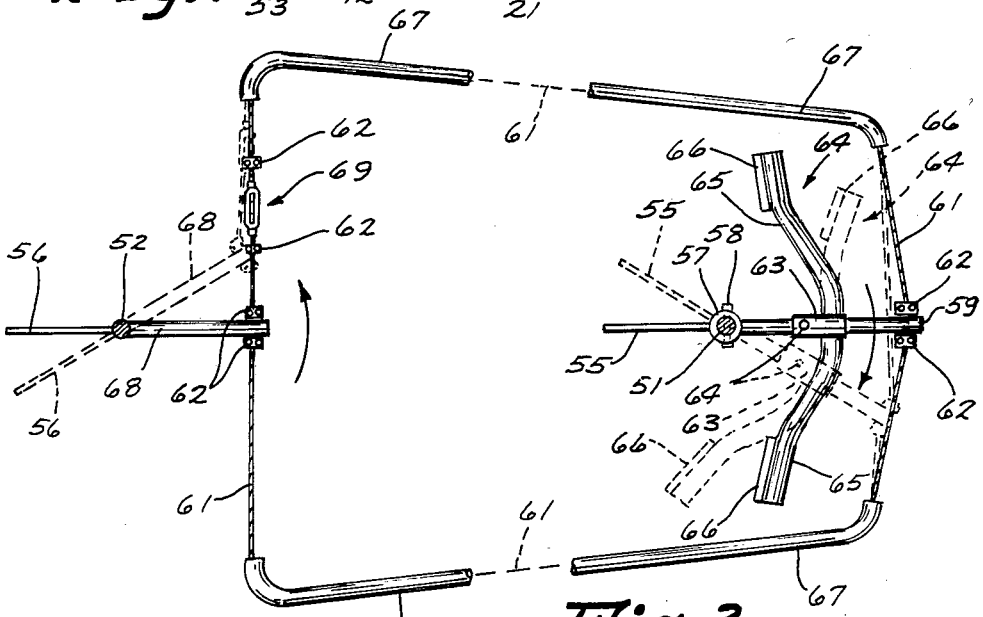
Fig. 3
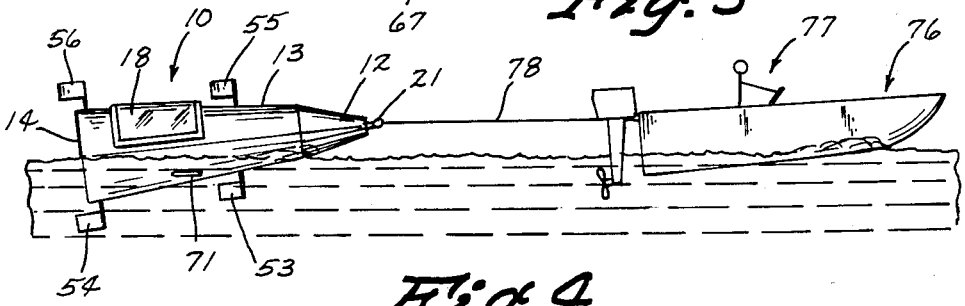
Fig. 4

RECREATIONAL WATERCRAFT

TECHNICAL FIELD

The present invention relates generally to a recreational watercraft, and more particularly to such a watercraft which has a plurality of rudders which permit sharp and rapid turning of such watercraft.

BACKGROUND ART

For centuries people have used objects floating in water for recreational purposes. Boats of various sizes and with various means of propulsion are well-known. Also, many objects have been designed to support a person or persons which are towed by a boat, most commonly these objects are water skis or similar boards for supporting a person in various ways.

The use of rudders or the pivoting of power propellers are commonly used for steering boats while shifting of body weight, in conjunction with steering of a towing vessel, is used for controlling the direction of movement of water skis or the like. It has not heretofore been practical to use rudders or the like on a recreational watercraft which is towed.

For some people, the art of water skiing is difficult to master and for other people who have substantial experience on water skis, water skiing tends to become boring after long periods of doing the same thing. Consequently, there is a need for new recreational watercrafts which are useful to provide recreational water activities for those unable or unwilling to use water skis or the like and to provide new and exciting water experiences for those who might wish to participate in them.

DISCLOSURE OF THE INVENTION

The present invention relates generally to a recreational watercraft having a housing and a structure disposed within the housing for supporting a person. The housing is adapted to be moved through the water by being towed, by having a power supply of its own, or in other ways such as with a sail or the like if desired. Rudders are provided on the forward part of the housing and on the rearward part of the housing and are linked together and are foot operated whereby movement of the forward rudder in one direction causes movement of the rear rudder in an equal and opposite direction for causing rapid movement from side to side of the watercraft. Additionally, hand operated rudders are provided for causing turning of the housing about a longitudinal axes.

An object of the present invention is to provide an improved recreational watercraft.

Another object of the invention is to provide a recreational watercraft for providing a completey different recreational experience than has heretofore been available.

A further object of the invention is to provide a recreational watercraft which can be towed or which can have its own power supply.

A still further object of the invention is to provide a recreational watercraft of the aforementioned type which can be rapidly turned from side to side or about its longitudinal axis.

A still further object of the invention is to provide a recreational watercraft of the aforementioned type which has an adjustable ballast mechanism associated therewith.

Other objects, advantages, and novel features of the present invention will become apparent from the following detailed description of the invention when considered in conjunction with the accompanying drawings.

BRIEF DESCRIPTION OF THE DRAWINGS

FIG. 1 is a perspective view of a recreational watercraft constructed in accordance with the present invention;

FIG. 2 is a schematic view of the rudder control arrangement of the recreational watercraft shown in FIG. 1;

FIG. 3 is a top plan view of the foot controlled front and rear rudder assemblies;

FIG. 4 is a side elevational view showing the present invention in use being towed behind a boat in the water;

BEST MODES FOR CARRYING OUT THE INVENTION

Figure 5:
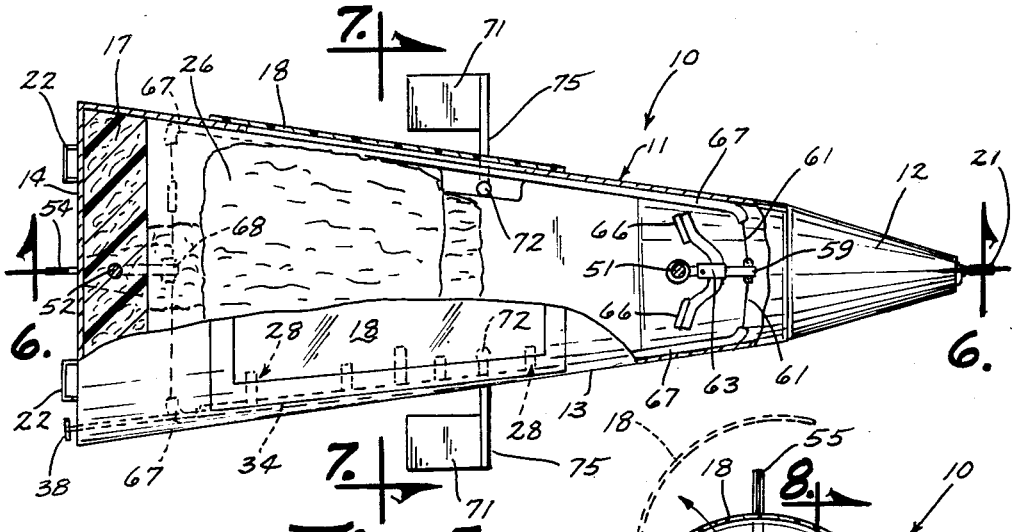
FIG. 5 is a cross-sectional view of the apparatus taken along line 5—5 of FIG. 1.
Figure 7:
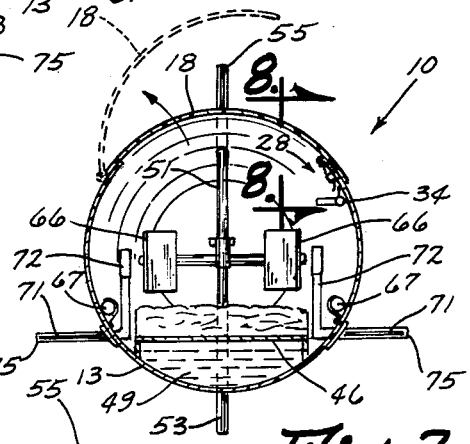
FIG. 7 is a cross-sectional view taken along line 7—7 of FIG. 5.
Figure 6:
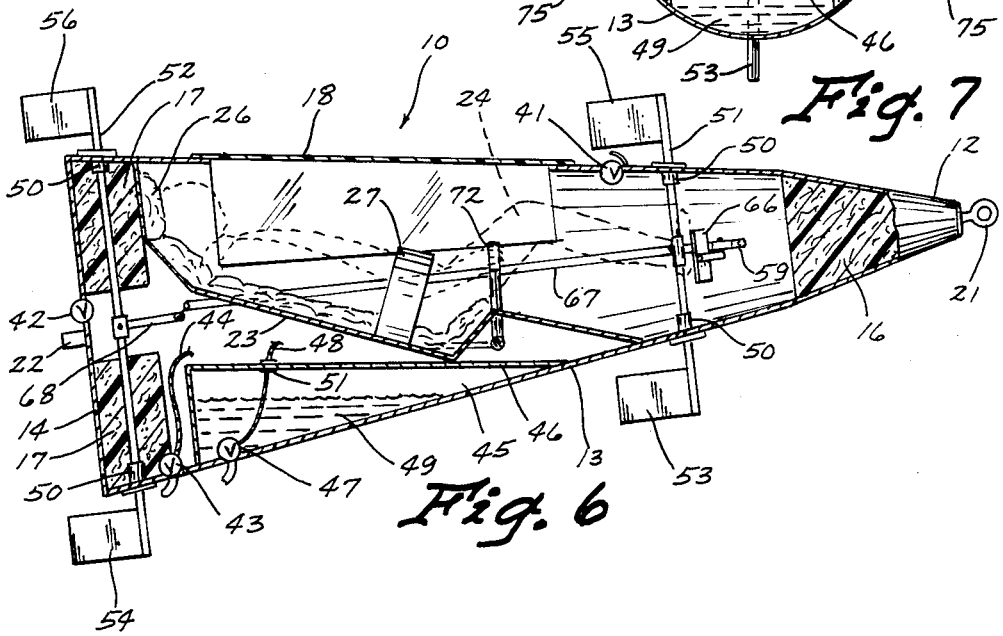
FIG. 6 is a cross-sectional view taken along line 6—6 of FIG. 5.

Referring now to the drawings wherein like reference numerals designate identical or corresponding parts throughout the several views, FIG. 1 shows a recreational watercraft (10) constructed in accordance with the present invention. Referring now to FIGS. 5–7, it is noted that the watercraft (10) includes a housing (11) with a front cone portion (12), an intermediate frusto-conical portion (13) and a rear wall (14). The front conical housing portion (12) has flotation material (16) disposed therein and flotation structure (17) is disposed near the rear wall (14).

A clear plexiglass door (18) is pivotally attached to housing portion (13) by a hinge structure (19). A front eyelet (21) is rigidly attached to the front conical portion of the housing (12) for reasons which will be explained below and a pair of handles (22) are attached to the rear wall (14) for facilitating easy handling of the recreational vehicle (10) for loading in a vehicle to be transported to a place and for facilitating easy movement into and out from the vehicle to the water where it is to be used.

Referring in particular to FIG. 6, it is noted that a sheet metal wall (23) is rigidly affixed to the side of the housing (11) and that this sheet metal structure (23) is of a particular shape to provide support for a person (24) in the position shown in dashed lines in FIG. 6. Padded material (26) is provided along a substantial portion of the upper side of the sheet metal member (23) to provide comfort to the person (24) disposed within the housing (11). A seat belt (27) is attached to the sheet metal portion (23) or, alternatively, to some other portion of the housing (11) for the purpose of holding the person (24) firmly in place during the use of the recreational watercraft (10).

Figure 9:
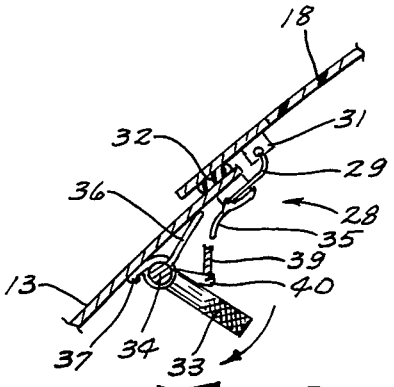
FIG. 9 is an enlarged cross-sectional view taken along line 9—9 of FIG. 8, showing a door latching mechanism in the latched position thereof.

To enter the recreational watercraft (10), the door (18) is opened from the position shown in solid lines in FIG. 7 to the position shown in dashed lines in FIG. 7, whereupon the person (24) can move to the position shown in dashed lines in FIG. 6. Once inside the craft (10), the person (24) can buckle the individual over-center buckles (28). The over-center buckles (28) are of a type used on old trunks or the like having an over-center position as shown in FIG. 9 when the end (29) is disposed over a portion of the member (31) on the door (18). A rubber seal (32) is disposed around the edge of the door (18) for the purpose of sealing the door (18) against the side of the housing (13).

Figure 10:
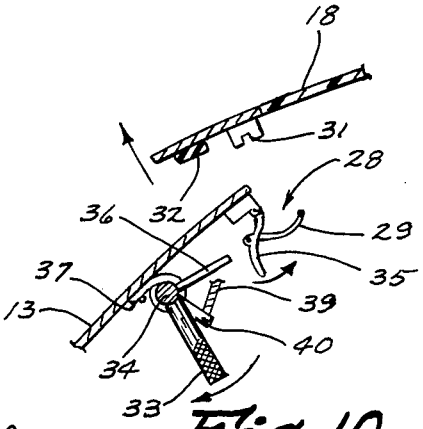
FIG. 10 is a view similar to FIG. 9 but showing the latching mechanism for the door unlatched.

When a person (24) is desirous of getting out of the recreational watercraft (10), a handle (33), which is pivotally attached to the housing portion (13) by a rod (34) and brackets (36), can be moved from the position shown in FIG. 9 to the position shown in FIG. 10. This causes movement of levers (36), which are positioned beneath the over-center members (35), to cause the over-center levers (35) to be moved from the position shown in FIG. 9 to the position shown in FIG. 10, thereby releasing all of the buckles (28) and permitting the door (18) to be readily opened.

It is noted that ventilation valves (41) and (42) are disposed within the housing walls (13) and (14), respectively, of the recreational watercraft (10) for the purpose of assuring that adequate amounts of fresh air will be available to the person (24) disposed within the housing (13) and yet prevent excessive amounts of water from entering the housing (11). Additionally, a drain valve (43) is disposed in the bottom of the housing wall (13) and is spring biased to a closed position. A cable (44), having one end thereof extending up to and conveniently accessible to the person (24) is attached at the other end to valve (43), whereby when the recreational watercraft is moving and the cable (44) is pulled, the valve (43) will open and water will be sucked out of the inside of the housing (11) through the drainage valve (43).

A ballast compartment (45) is formed by a sheet metal member (46) which is sealingly attached to the bottom wall (13) of the recreational watercraft (10) as can best be seen in FIG. 6. This ballast compartment (45) has a valve (47) disposed to the wall (13). Cable (48) is slideably and sealably extended through the wall (46) and one end of the cable (48) is also conveniently disposed adjacent to the person (24) within the housing (11). The purpose of this valve (47) and ballast compartment (45) is for adjusting the amount of weight within the housing (11). It is desirable that the watercraft (10) be at a certain level in the water, and if the person (24) is not heavy enough to cause the craft (10) to be at such low level in the water, then the operator (24) merely pulls on cable (44) to open the valve (47) to let water (49) enter the ballast compartment (45). A slight space around seal (51), where the cable (48) goes through the sheet metal member (46), provides enough of a vent to allow water to enter the ballast compartment (45). The valve (47) is a biased closed valve similar to the valve (43) mentioned above.

Referring now to FIGS. 2 and 3, it is noted that the rudder control assembly is shown schematically. A first generally vertically disposed shaft (51) is rotatably mounted to and through the front portion of the housing (13) and a similar vertically disposed shaft (52) extends through the rear portion of the housing portion (13). Lower rudder (53) is attached to the front shaft (51) and lower rudder (54) is attached to the bottom of the rear shaft (52). Similarily, upper rudder (55) is rigidly attached to the top of front rudder (51) and top rudder (56) is rigidly attached to the top of the rear shaft (52). A collar (57) extends around the front shaft (51) and is held in place by locking fastener (58). The collar (57) has a horizontally disposed and centilever shaft (59) extending forwardly therefrom. This cantilever shaft (59) has a pedal assembly (62) mounted thereto by a sleeve (63) having a set screw (64) disposed therethrough in a threaded fashion, whereby the sleeve (63) can be adjusted to the length of the legs of the user (24) (FIG. 6). Once this adjustment is made, the set screw (64) can be tightened down against the cantilever member (59) to hold the pedal assembly (64) in place. Pads (66) are provided on each side of the pedal assembly (64) and are attached to arms (65) extending in each direction from the collar (63).

The cable (61) extends from the cantilever member (59) over to each side thereof and through conduits (67) which are attached to the side of the housing (13) and extend rearwardly to thereby extend over and connect to the ends of another cantilever member (68). This cantilever member (68) is rigidly attached to the rear vertically extending shaft (52), for example, by welding. A turnbuckle assembly (69) is attached by fasteners (62) within the endless cable (61) whereby the tightness of the cable (61) can be adjusted if it stretches or changes in length for any other reason.

Side rudders (71), shown in FIGS. 1 and 2, are provided for permitting the watercraft (10) to be caused to rotate about its longitudinal axes by movement of handles (72) forwardly or rearwardly as indicated by the arrows (73) in FIG. 2. Forward movement of the handles (72) will cause the rudder (71) to be pivoted upwardly, and rearward movement of the handles (72) will cause movement of the corresponding rudder (71) in a downward direction. Bearings (74) are provided for reducing friction while rotatably attaching the shaft (75) to the housing portion (13).

Figure 8:
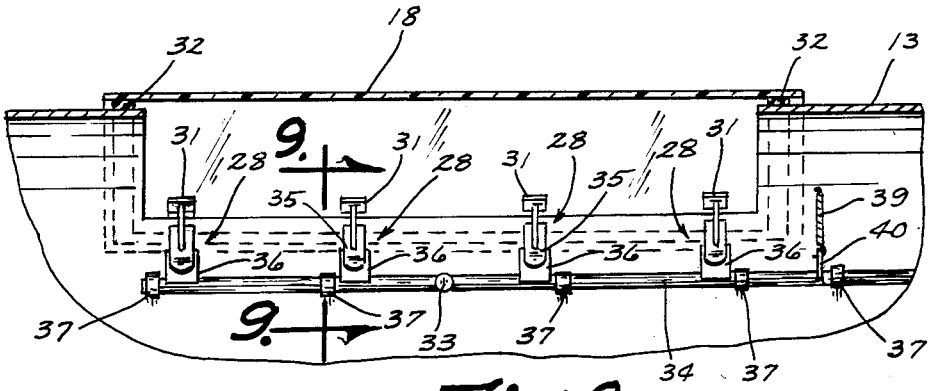
FIG. 8 is a partial enlarged cross-sectional view taken along line 8—8 of FIG. 7.

In operation, the user of the recreational craft (10) would first cause the recreational craft (10) to be attached to a boat (76), for example as shown in FIG. 4 having an operator (77). A tow rope (78) would be utilized to attach the boat (76) to the eyelet (21) of the craft (10). Then the operator (24) would open the door (18) from the position shown in solid lines in FIG. 7 to the position shown in dashed lines in FIG. 7, and would then crawl into the craft (10) and assume the position shown in FIG. 6. The door (18) would be closed and the buckles (28) would be utilized to seal the door (18) closed in the fashion shown in FIGS. 8 and 9. Assuming that the craft (10) is in the water at that time, then the ballast chamber (44) would be adjusted by providing enough water in the ballast chamber (44) by use of the cable (48) and the valve (47) whereby the side rudders (71) will be completely under water by a predetermined distance. Typically, then the rudders would be in the position shown in FIG. 1 until the craft (10) begins to be towed through the water, for example as shown in FIG. 4.

If the left leg is extended and pushed against the pad (66), for example as shown in FIG. 3, to the position shown in dashed lines in FIG. 3, then the front rudders (53) and (55) will move accordingly from the position shown in solid lines in FIG. 3 to the position shown in dashed lines in FIG. 3, thereby tending to cause the front end of the craft (10) to be pushed to the right. At the same time, because of the connection of the cables (61) to the rear rudder assembly, the rear rudders (54) and (56) will be moved from the position shown in solid lines in FIG. 3 to the position shown in dashed lines in FIG. 3, thereby causing the rear end of the craft (10) to be pushed to the left. Consequently, it will be appreciated that very quick turning from side to side will be achieved by use of such a steering mechanism using the feet only of the operator. This very quick turning in one direction or the other will create a very exciting ride. It will of course also be appreciated that if the right foot is extended, whereby the pivoting from the solid position shown in solid lines in FIG. 3 is in the opposite direction from that shown in dashed lines, an opposite steering effect will be accomplished, whereby the front end of the craft (10) will be moved to the left and the rear end of the craft (10) will be moved to the right. This movement can be varied by the degree and frequency of movement of the feet of the operator (24).

If it is desired to rotate the craft (10) about the longitudinal axis of the craft (10), then one of the handles (72) is moved forwardly and the other handle (72) is moved rearwardly, thereby causing one of the rudders (71) to move downwardly and the other of the rudders (71) to move upwardly, causing rotation of the craft in one rotational direction about its longitudinal axis. Opposite movement of the handles (72) whereby the other handle is moved rearwardly and the opposite one forwardly, causes an opposite rotational direction. It is also to be noted that usually a combination of hand and feet rudder movements would be utilized, whereby the foot movement will cause side-to-side movement and use of the hand rudders (71) will cause a rotational movement. Consequently, the operator (24) can make the ride as exciting as desired by moving the controls to a small or large degree and with any frequency or combination desired.

Figure 11:
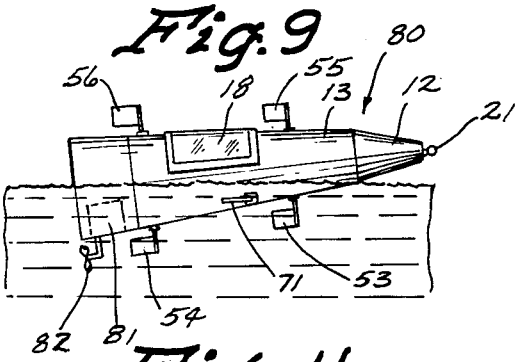
FIG. 11 shows an alternate form of the present invention shown with its own power supply and a propeller rotated by such power supply.

Referring now to FIG. 11, it is noted than an alternate embodiment (80) is shown, which is like the embodiment (10) in all respects except that it has its own power supply (81) which turns a propeller (82). Consequently, the embodiment (80) does not need to be towed by another vessel, yet it has all of the rudder controls of the embodiment (10) as referred to above.

Accordingly, all of the aforementioned objects are accomplished by the preferred embodiments shown herein. Obviously, many modifications and variations of the present invention are possible in light of the above teachings. It is therefore to be understood that, within the scope of the appended claims, the invention may be practiced otherwise than as specifically described.

I claim:

1. A recreational watercraft comprising:

a housing;

seating means disposed in said housing for supporting a person;

control means attached to said housing for guiding said watercraft through the water comprising:

a first generally vertically disposed shaft rotatably attached to a forward portion of said housing;

a first bottom rudder means disposed on one side of said first shaft for affecting the movement of said watercraft as it moves through the water;

a first top rudder means disposed on the other end of said first vertical shaft for affecting the movement of said watercraft as it moves through the water;

a second generally vertically disposed shaft rotatably attached to a rear portion of said housing;

a second bottom rudder means disposed on one end of said second shaft for affecting the movement of said watercraft as it moves through the water;

a second top rudder means disposed on one end of said second vertical shaft for affecting the movement of said watercraft as it moves through the water;

foot engageable means operably attached to a lower portion of said first shaft for selectively rotating said first shaft in one direction or the other;

interconnecting means operably attached to said foot engageable means and to the second shaft for moving the second shaft proportionally in an opposite direction to the movement of the first rudder means thereby permitting rapid turning of said housing in the water upon actuation of the control means , said interconnecting means including a first horizontally disposed cantilever member connected to said first vertical shaft, a second horizontally disposed canitlever member connected to said second vertical shaft, and cable means connected to said first and second cantilever members for causing one of said cantilever members to move in one direction when said other cantilever member is moved in the other direction;

means for connecting said foot engageable means to said first horizontally disposed cantilever member, said foot engageable means extending to both sides of said first shaft at all times so it can be engaged by both feet of a person within the housing;

conduit means connected to each inner side of the housing for guiding said cable means around the seating means from one of said cantilever means to the other;

door means for selectively opening said housing for access or closing said housing for use; and ballast means for insuring that said door means will be on top of said watercraft when the watercraft is stopped.

2. The recreational watercraft of claim 1 including:

a first horizontally disposed shaft rotatably attached to an intermediate portion of one side of said housing; and a first side rudder means operably attached to one end of said first horizontally disposed shaft for affecting the movement of said watercraft as it moves through the water.

3. The recreational watercraft of claim 2 including:

a second horizontally disposed shaft rotatably attached to an intermediate portion of the other side of said housing; and a second side rudder means operably attached to one end of said second horizontally disposed shaft for affecting the movement of said watercraft as it moves through the water.

4. The recreational watercraft of claim 1 including seal means around said door means for keeping water out of said housing.

5. The recreational watercraft of claim 1 including latching means attached to said door means and said housing for selectively latching the door means shut or permitting it to be unlatched for opening.

6. The recreational watercraft of claim 1 including flotation means disposed within said housing for preventing the housing from sinking.

7. The recreational watercraft of claim 1 including ventilation means for permitting fresh air to enter said housing.

8. The recreational watercraft of claim 1 including drain means attached to the bottom of said housing for permitting water to be drained from said housing.

9. The recreactional watercraft of claim 1 wherein said ballast means includes means for selectively permitting water to enter or exit a compartment in said housing for adjusting the level of disposition of said housing in the water in which it is floating.

10. The recreational watercraft of claim 9 including means operable from inside of said housing for adjusting said ballast means.

11. The recreational watercraft of claim 1 including means for attaching a tow rope to the front of said housing.

12. The recreational watercraft of claim 11 wherein the front of said housing is streamlined.

13. The recreational watercraft of claim 1 including self-contained power means for selectively causing said housing to be propelled through the water.

* * * * *